US007278876B2

(12) United States Patent
Hara et al.

(10) Patent No.: US 7,278,876 B2
(45) Date of Patent: Oct. 9, 2007

(54) CONNECTOR IN WHICH TWO HOUSINGS HOLDING A CABLE ARE FIRMLY ENGAGED WITH EACH OTHER

(75) Inventors: Seiichi Hara, Tokyo (JP); Kiminobu Tabata, Tokyo (JP); Takeshi Kai, Saitama (JP); Tsutomu Fukui, Saitama (JP); Masaru Shinmura, Saitama (JP); Tadashi Inazu, Saitama (JP); Shigeki Takahashi, Saitama (JP)

(73) Assignees: Japan Aviation Electronics Industry, Limited, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/645,467

(22) Filed: Dec. 26, 2006

(65) Prior Publication Data

US 2007/0167066 A1 Jul. 19, 2007

(30) Foreign Application Priority Data

Dec. 27, 2005 (JP) ..... 2005-374341

(51) Int. Cl.
*H01R 13/85* (2006.01)

(52) U.S. Cl. ..... 439/449; 439/455

(58) Field of Classification Search ..... 439/449, 439/452, 455

See application file for complete search history.

(56) References Cited

U.S. PATENT DOCUMENTS 4,618,200 A * 10/1986 Roberts et al. ..... 439/367
4,842,549 A * 6/1989 Asick et al. ..... 439/464
5,041,007 A * 8/1991 Liu et al. ..... 439/404
5,295,859 A * 3/1994 Kawai et al. ..... 439/455
5,681,180 A * 10/1997 Rodrigues ..... 439/404
5,831,815 A * 11/1998 Miller et al. ..... 361/679
6,371,794 B1 * 4/2002 Bauer et al. ..... 439/404
6,752,658 B2 * 6/2004 Jones ..... 439/581

FOREIGN PATENT DOCUMENTS

JP 11-185869 7/1999
JP 11-339882 12/1999

* cited by examiner

*Primary Examiner*—Truc Nguyen
(74) *Attorney, Agent, or Firm*—Collard & Roe, P.C.

(57) ABSTRACT

A connector includes two housings coupled with each other to hold a cable therebetween. One of the housings includes a cable receiving portion for receiving the cable, a restricting portion adjacent to the cable receiving portion, a first wall portion formed outside the restricting portion and defining a space between the first wall portion and the restricting portion, and a first engaging portion inwardly protruding from the first wall portion. Another of the housings includes a cable pressing portion for pressing the cable towards the cable receiving portion and the restricting portion, and a second wall portion formed adjacent to the cable pressing portion and inserted into the space. The second wall portion has a second engaging portion extending outward from the second wall portion. The first and the second engaging potions are engaged with each other to prevent the housings from separating from each other.

8 Claims, 5 Drawing Sheets

CONNECTOR IN WHICH TWO HOUSINGS HOLDING A CABLE ARE FIRMLY ENGAGED WITH EACH OTHER

This application claims priority to prior Japanese patent application JP 2005-374341, the disclosure of which is incorporated herein by reference.

BACKGROUND OF THE INVENTION

This invention relates to a connector of a type such that a cable is held between two housings.

Japanese Unexamined Patent Application Publication (JP-A) No. H11-185869 discloses a connector having a connector housing and a cover capable of opening and closing one surface of the connector housing. The connector housing has an engaging portion. On the other hand, the cover has an engaging portion also. When the cover is closed, the engaging portions are engaged with each other so that the cover is fixed to the connector housing in a closed state.

However, each of the engaging portions is easily displaced with elastic deformation thereof. Therefore, the engaging portions may be disengaged from each other due to relative displacement. Accordingly, there arises a problem if such engaging structure is used in the connector in order to fix two housings for holding a cable.

Japanese Unexamined Patent Application Publication No. H11-3398B2 discloses a connector in which a cable is held between a connector housing and a pressing portion of a cover coupled with the connector housing. In this connector, the connector housing is provided with a cable holding groove adapted to receive the cable. After the cable is received in the cable holding groove, the cover is coupled with the connector housing. The cable is clamped between the cable holding groove and the pressing portion.

However, if an external force is applied upon the pressing portion through the cable, the cover may be released from the connector housing. The connector disclosed in Japanese Unexamined Patent Application Publication (JP-A) No. H11-339882 has no means for preventing the cover from being released. In order to prevent the cover from being released from the connector housing, it would be necessary to use a special anti-release mechanism including additional components or to use a complicated structure.

SUMMARY OF THE INVENTION

It is therefore an object of this invention to provide a connector in which two housings with a cable held therebetween are firmly engaged with each other and prevented from being disengaged from each other.

Other objects of the present invention will become clear as the description proceeds.

According to an aspect of the present invention, there is provided a connector to be connected to a cable, the connector comprising an electrically conductive contact to be connected to the cable and a housing holding the contact, the housing comprising first and second housings coupled with each other in a first direction, the first housing comprising a cable receiving portion for receiving at least a part of the cable in a radial direction of the cable, a restricting portion formed adjacent to the cable receiving portion in a second direction perpendicular to the first direction, a first wall portion formed outside the restricting portion in the second direction and defining a space between the first wall portion and the restricting portion, and a first engaging portion inwardly protruding from the first wall portion in the second direction, the second housing comprising a cable pressing portion for pressing the cable towards the cable receiving portion and the restricting portion, and a second wall portion formed adjacent to the cable pressing portion in the second direction and inserted into the space, the second wall portion having a second engaging portion extending outward from the second wall portion in the second direction, the first and the second engaging potions being engaged with each other to prevent the first and the second housings from separating from each other.

DESCRIPTION OF THE PREFERRED EMBODIMENTS

Figure 1:
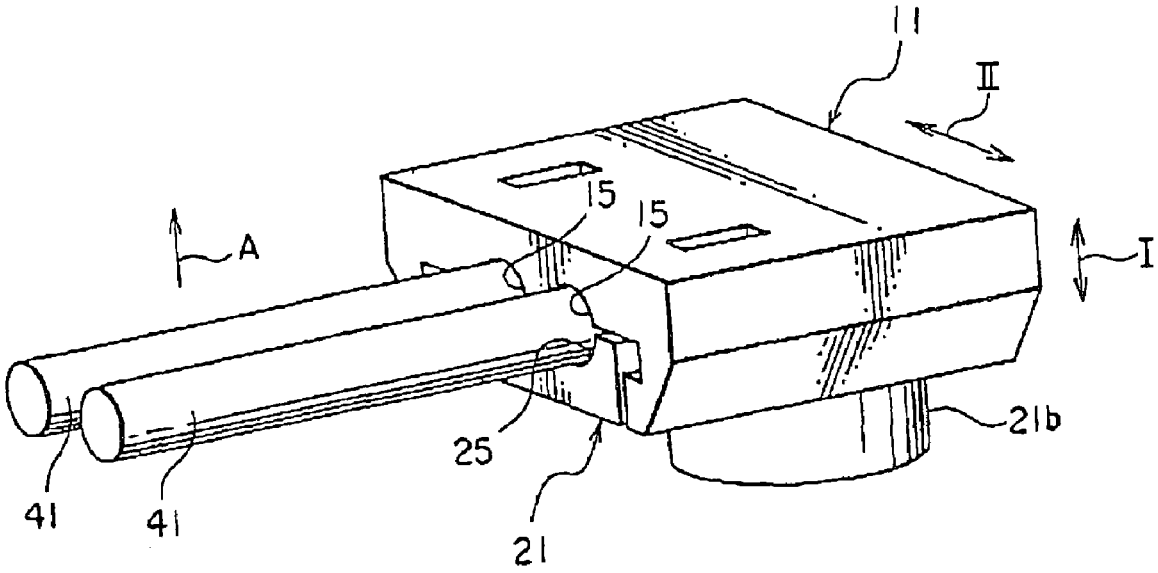
FIG. 1 is a top perspective view of a connector according to an embodiment of this invention together with cables.
Figure 2:
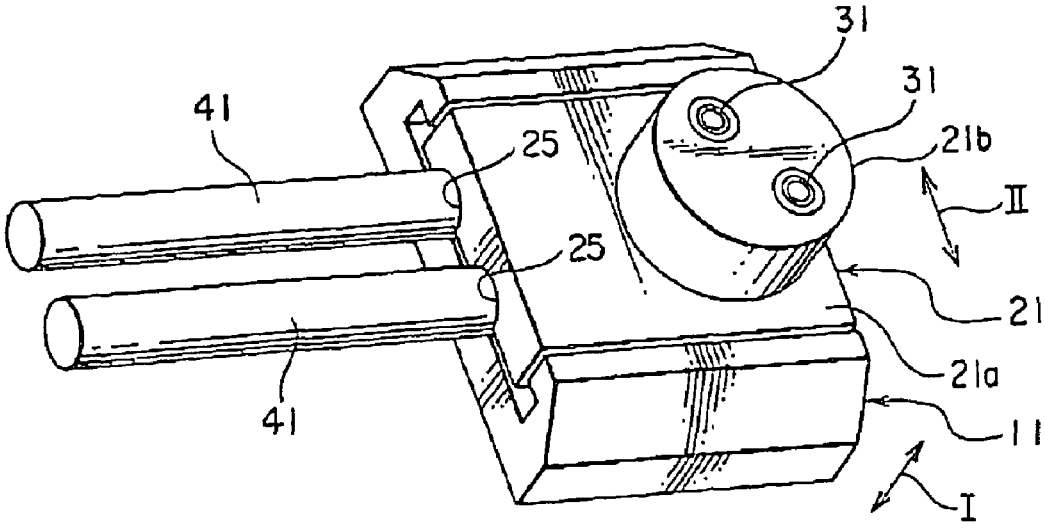
FIG. 2 is a bottom perspective view of the connector illustrated in FIG. 1.
Figure 3:
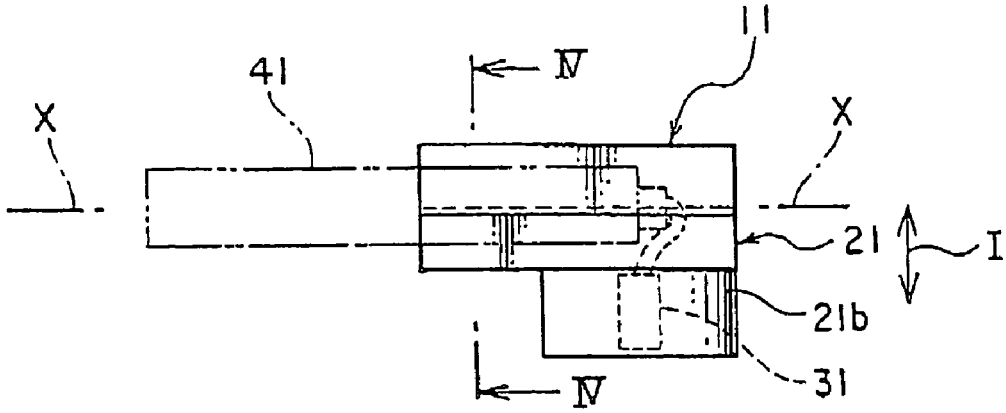
FIG. 3 is a schematic side view of the connector illustrated in FIGS. 1 and 2.

Referring to FIGS. 1 to 7, description will be made of a structure of a connector according to an embodiment of this invention.

FIGS. 1 to 4 show the connector in an assembled state. The connector comprises a first housing 11, a second housing 21 coupled with the first housing 11 in a first direction I, and two electrically conductive contacts 31 held by the second housing 21. The first and the second housings 11 and 21 are made of an elastic insulating material and hold two cables 41 by clamping the cables 41 therebetween. Each of the contacts 31 is connected to one end of the cable 41 corresponding thereto. The cables 41 are extracted along an axis X perpendicular to the first direction I.

The first housing 11 has a first base portion 11*a* of a generally plate-like shape and a pair of first wall portions 11*b* extending in the first direction I from opposite ends of the first base portion 11*a* in a second direction II perpendicular to the first direction I and the axis X, respectively. The second housing 21 has a second base portion 21*a* of a generally plate-like shape and a fitting portion 21*b* formed on one surface of the second base portion 21*a* to be integral therewith and receiving the contacts 31.

The first and the second housings 11 and 21 have cable holding means holding the cables 41. The cable holding means has a first holding portion 13 formed on the first housing 11 and a second holding portion 23 formed on the second housing 21 so as to be engaged with the first holding portion 13.

The first holding portion 13 has a pair of cable receiving portions 15 formed on the first base portion 11*a* between the first wall portions 11*b* so as to receive the one ends of the cables 41, a pair of restricting portions 17 adjacent to the cable receiving portions 15 and faced to inner surfaces of the first wall portions 11*b* with spaces left therefrom, respectively, and a pair of first engaging portions 19 formed on end portions of the first wall portions 11*b* in the first direction I outside the restricting portions 17.

Each of the cable receiving portions 15 is shaped so as to cover an approximate half of an outer circumferential surface of each cable 41 on one side when the first and the second housings 11 and 21 are coupled with each other. The first engaging portions 19 protrude inward from the first wall portions 11*b* in the second direction II and have first engaging surfaces 19*a* faced to the first base portion 11*a*, respectively.

The second holding portion 23 has a pair of cable pressing portions 25 formed on an inner surface of the second base portion 21*a* so as to receive the one ends of the cables 41, a pair of second wall portions 27 as second wall portions formed adjacent to the cable pressing portions 25, and a pair of second engaging portions 29 to be engaged with the first engaging portions 19, respectively.

Each of the cable pressing portions 25 is shaped so as to cover an approximate half of the outer circumferential surface of each cable 41 on the other side when the first and the second housings 11 and 21 are coupled with each other. The second engaging portions 29 protrude outward from a pair of side surfaces 21*c* of the second base portion 21*a* and have second engaging surfaces 29*a* to be engaged with the first engaging surfaces 19*a* of the first engaging portions 19, respectively, when the first and the second housings 11 and 21 are coupled with each other. The first engaging surfaces 19*a* and the second engaging surfaces 29*a* are generally parallel to each other.

The first base portion 11*a* of the first housing 11 is provided with spaces 11*d* formed between the restricting portions 17 and the first wall portions 11*b* to serve as escape portions. Into the spaces 11*d*, the second wall portions 27 enters when the second wall portions 27 and the second engaging portions 29 are inserted between the restricting portions 17 and the first engaging portions 19 so that the first and the second engaging portions 19 and 29 are engaged with each other.

The first base portion 11*a* of the first housing 11 is provided with a first protrusion 11*f* extending from a position between the cable receiving portions 15. The second base portion 21*a* of the second housing 21 is provided with a second protrusion 21*f* extending from a position between the cable pressing portions 25. The first and the second protrusions 11*f* and 21*f* are butted to each other at their end faces when the first and the second housings 11 and 21 are engaged with each other.

Figure 5:
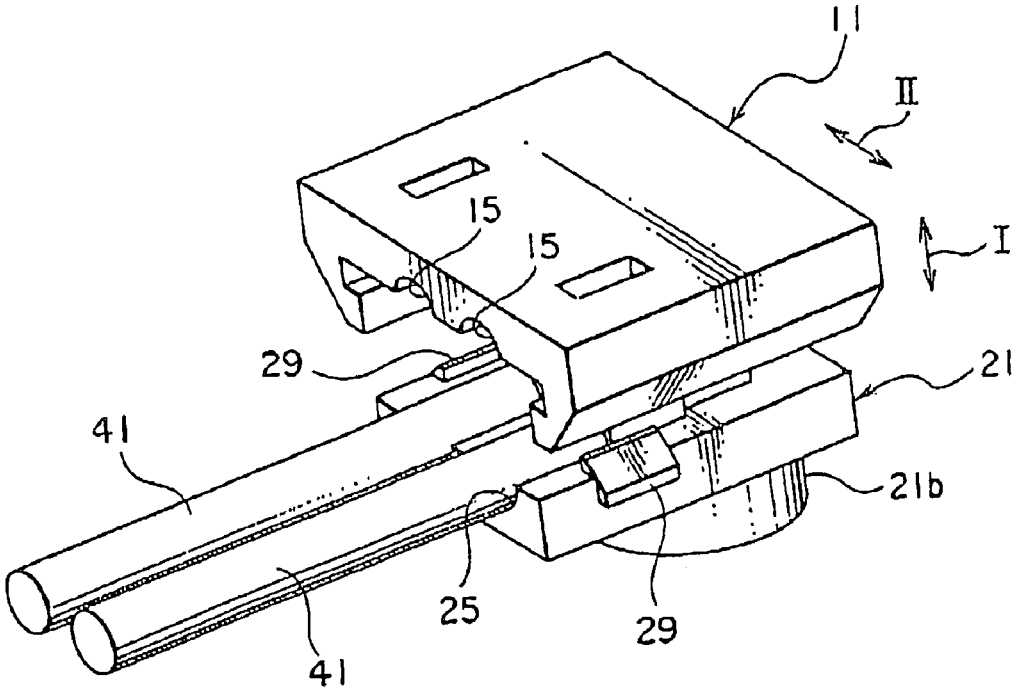
FIG. 5 is a perspective view of the connector illustrated in FIGS. 1 to 3 in a disassembled state.
Figure 6:
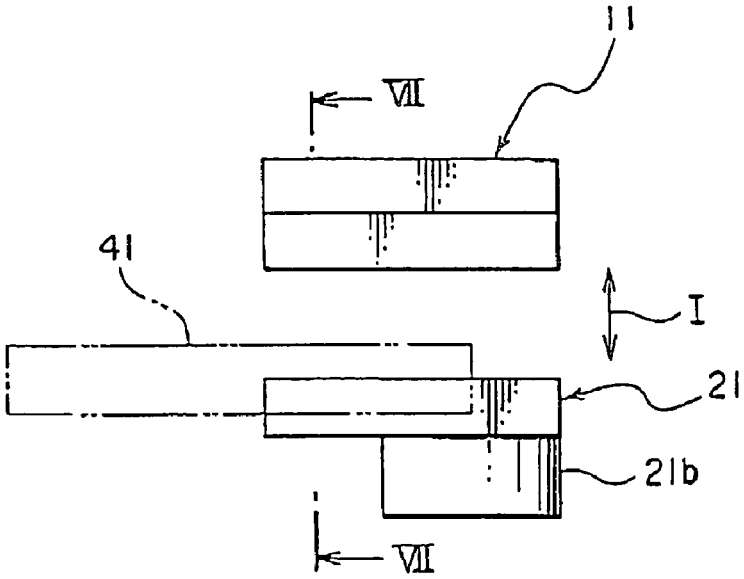
FIG. 6 is a schematic side view of the connector in the disassembled state illustrated in FIG. 5.
Figure 7:
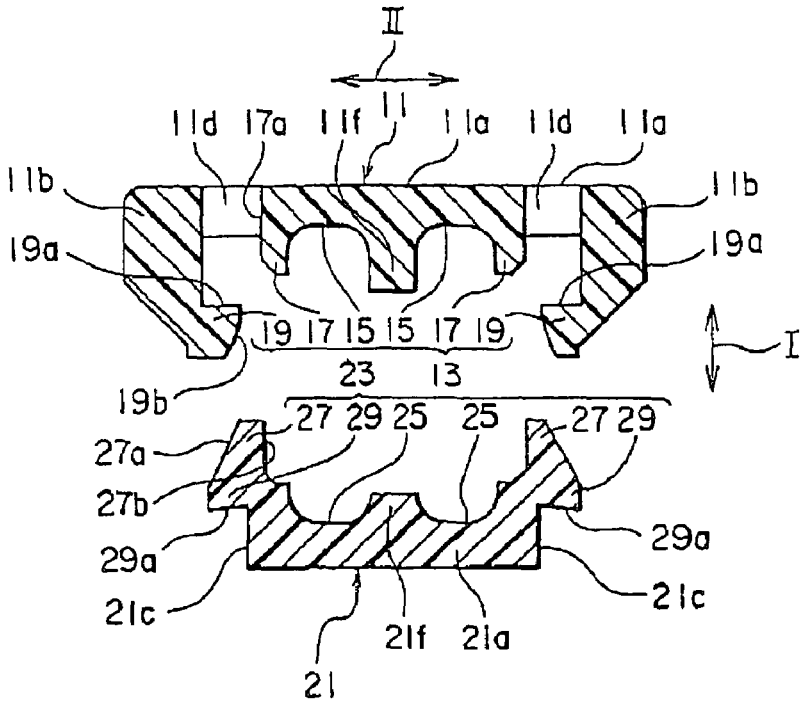
FIG. 7 is a sectional view taken along a line VII-VII in FIG. 6.

Referring to FIGS. 5 to 7, the connector is shown in a disassembled state. In other words, the first and the second housings 11 and 21 are separated from each other.

Before the first and the second housings 11 and 21 are assembled, the one ends of the cables 41 are received in the cable pressing portions 25 of the second housing 21 and core wires of the cables 41 are connected to the contacts 31. Then, the cable receiving portions 15 of the first housing 11 are faced to the one ends of the cables 41 received in the cable pressing portions 25 of the second housing 21. In this state, the second housing 21 and the first housing 11 are pressed relative to each other in the first direction I. As a consequence, the second wall portions 27 of the second housing 21 are pushed between the restricting portions 17 and the first engaging portions 19.

When the second wall portions 27 are pushed between the restricting portions 17 and the first engaging portions 19, slant surfaces 27*a* of the second wall portions 27 slide along slant surfaces 19*b* of the first engaging portions 19 to deform the first engaging portions 19 into an outwardly bent shape. The first housing 11 is made of resin so that the restricting portions 17 and the first engaging portions 19 are deformable and elastically restorable from a deformed state.

When the second wall portions 27 are further pushed, the second wall portions 27 are completely inserted between the restricting portions 17 and the first engaging portions 19. As a result, confronting surfaces 27*b* of the second wall portions 27 are faced and contacted to restricting surfaces 17*a* of the restricting portions 17 in the second direction II. It should be noted here that the restricting surfaces 17*a* extend in the first direction I at a position inward from the first engaging surfaces 19*a* in the second direction II.

Figure 4:
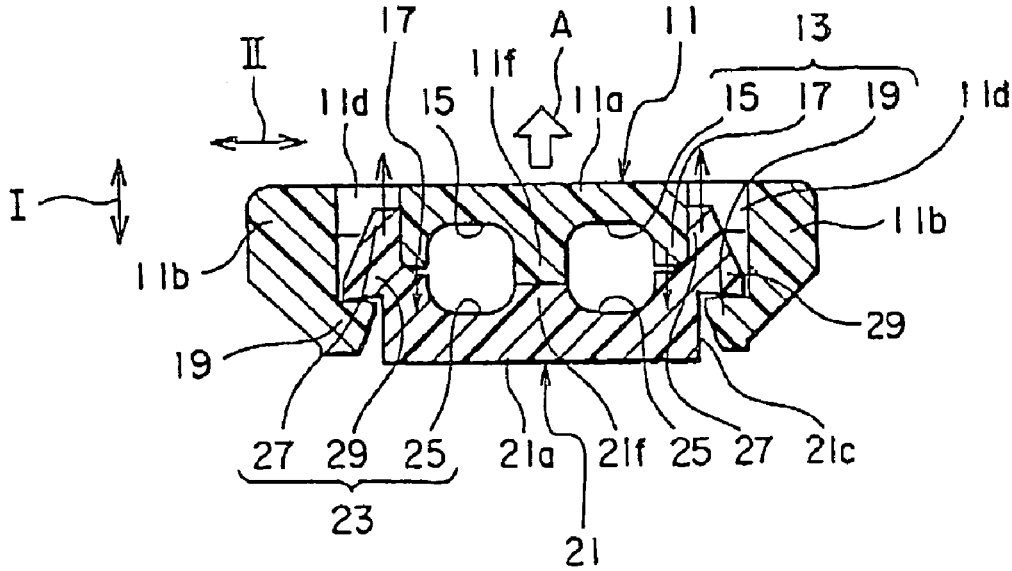
FIG. 4 is a sectional view taken along a line IV-IV in FIG. 3.

In this state, the restricting portions 17 and the first engaging portions 19 are elastically restored into the state illustrated in FIG. 4. As a consequence, the first engaging surfaces 19*a* of the first engaging portions 19 and the second engaging surfaces 29*a* of the second engaging portions 29 are faced to each other in the first direction I so that the first and the second engaging portions 19 and 29 are engaged with each other. Accordingly, the cables 41 are clamped and held by the first and the second housings 11 and 21. More particularly, the cable pressing portions 25 press the cables 41 towards the cable receiving portions 15 and the restricting portions 17.

After the connector is assembled, the fitting portion 21*b* is fitted to a mating fitting portion of a mating connector (not shown) so that the contacts 31 are connected to mating contacts formed in the mating fitting portion.

It is assumed here that a pulling operation of lifting the cables 41 towards the first housing 11 is performed as depicted by an arrow A in FIGS. 1 and 4. In this event, the restricting portions 17 are applied with outward forces as depicted by arrows B in FIG. 8 and the first engaging portions 19 are applied with pressing forces by the second engaging portions 29. Therefore, forces of inwardly inclining the second wall portions 27 are suppressed. Accordingly, the first engaging portions 19 are applied with inward forces as depicted by arrows C and, therefore, are hardly opened outward.

Further, a center part of the first base portion 11*a* of the first housing 11 rises upward. Consequently, the first housing 11 is deformed in a manner such that the first engaging portions 19 are wedged inward the second engaging portions 29 in tight contact therewith. Therefore, a holding force of the first housing 11 is improved. Accordingly, the first housing 11 is prevented from being released due to a pulling load of the cables 41. In addition, areas where the first engaging portions 19 of the first housing 11 support the second engaging portions 29 of the second housing 21 is lengthened in the second direction II so that the second engaging portions 29 is improved in strength against falling down or inclination.

Figure 9:
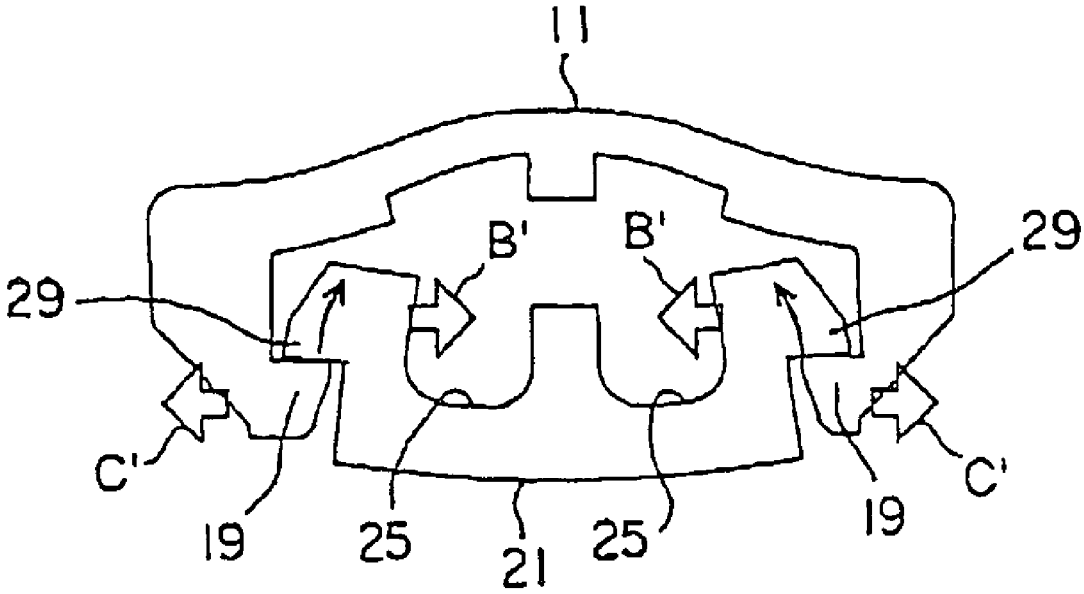
FIG. 9 is a view for describing an operation of a comparative connector.

Referring to FIG. 9, the description will be made as regards a comparative connector. Similar parts or portions are designated by like numerals.

Figure 8:
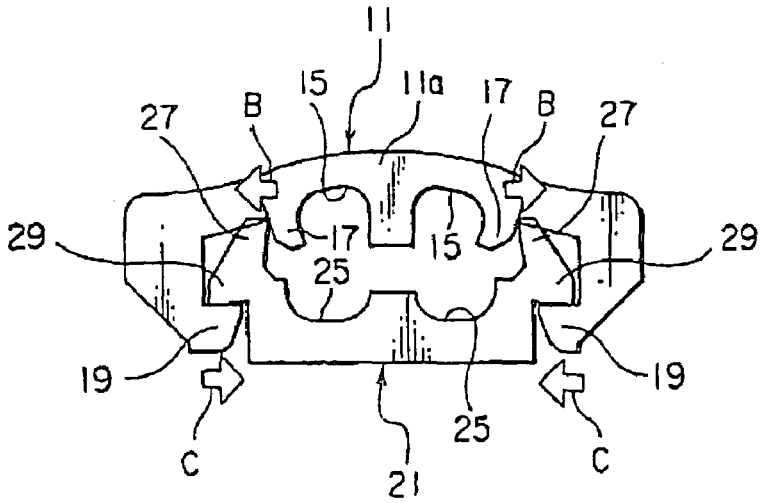
FIG. 8 is a view for describing an operation of the connector illustrated in FIGS. 1 to 7.

The comparative connector does not have the restricting portions 17 illustrated in FIG. 8. When the center portion of the first housing 11 is pulled upward by the cables 41, the second engaging portions 29 are applied with inward forces as depicted by arrows B', while the first engaging portions 19 are applied with outward forces as depicted by arrows C'. In this event, since the second engaging portions 29 are inwardly inclined, the first engaging portions 19 are outwardly deformed or opened. In the last result, the first housing 11 might be removed from the second housing 21. It is to be noted here that the removing of the first housing 11 from the second housing 21 originates in inward inclination of the second engaging portion 29 of the second housing 21.

While the present invention has thus far been described in connection with the preferred embodiment thereof, it will readily be possible for those skilled in the art to put this invention into practice in various other manners. In the foregoing, description has been made of the connector in which the first holding portion is formed on the first housing. Alternatively, with a structure in which the second holding portion is formed on the first housing and the first holding portion is formed on the second housing, it is also possible to prevent the first housing from being released by pulling the cables. In the foregoing, description has been made of the connector for connecting the two cables. However, this invention is also applicable to a connector for connecting one cable or three or more cables. In this case, the number of contacts is changed depending upon the number of the cables.

What is claimed is:

1. A connector to be connected to a cable, the connector comprising:

an electrically conductive contact to be connected to the cable; and a housing holding the contact;

the housing comprising first and second housings coupled with each other in a first direction;

the first housing comprising:

a cable receiving portion for receiving at least a part of the cable in a radial direction of the cable;

a restricting portion formed adjacent to the cable receiving portion in a second direction perpendicular to the first direction;

a first wall portion formed outside the restricting portion in the second direction and defining a space between the first wall portion and the restricting portion; and a first engaging portion inwardly protruding from the first wall portion in the second direction;

the second housing comprising:

a cable pressing portion for pressing the cable towards the cable receiving portion and the restricting portion; and a second wall portion formed adjacent to the cable pressing portion in the second direction and inserted into the space;

the second wall portion having a second engaging portion extending outward from the second wall portion in the second direction;

the first and the second engaging potions being engaged with each other.

2. The connector according to claim 1, wherein the restricting portion has a restricting surface faced to the first wall portion in the second direction, the second wall portion having a confronting surface close to the restricting surface.

3. The connector according to claim 2, wherein the restricting surface and the confronting surface extend in the first direction.

4. The connector according to claim 3, wherein the first engaging portion is farther from the cable receiving portion than the restricting surface in the second direction.

5. The connector according to claim 4, wherein the first and the second engaging portions are engaged with each other on a plane extending in the second direction.

6. The connector according to claim 1, wherein each of the first and the second housings has elasticity, the first engaging portion being faced to the space in the first direction, at least one of the first engaging portion and the second wall portion having a slant surface adapted to guide coupling of the first and the second housings.

7. The connector according to claim 1, wherein the second housing includes a fitting portion to be fitted to a mating connector, the contact being held by the fitting portion.

8. The connector according to claim 1, the connector has a symmetrical structure with respect to a portion having the cable receiving portion and the cable pressing portion in the second direction.

* * * * *